US007510091B2

(12) United States Patent
Sollers

(10) Patent No.: US 7,510,091 B2
(45) Date of Patent: Mar. 31, 2009

(54) PANEL SHIPPING RACK

(75) Inventor: Andy Sollers, Mogadore, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 498 days.

(21) Appl. No.: 11/236,364

(22) Filed: Sep. 27, 2005

(65) Prior Publication Data

US 2006/0064941 A1 Mar. 30, 2006

(51) Int. Cl.
*A47G 19/08* (2006.01)

(52) U.S. Cl. ..... 211/41.14

(58) Field of Classification Search ..... 211/41.14, 211/41.1, 41.15, 150; 206/736, 759, 454; 220/1.5; 280/79.11
See application file for complete search history.

(56) References Cited

U.S. PATENT DOCUMENTS 5,560,507 A * 10/1996 Arpin et al. ..... 220/1.5
6,120,206 A 9/2000 Benner et al.
6,450,514 B1 * 9/2002 Ronca ..... 280/79.11
6,742,663 B2 * 6/2004 Chubb ..... 211/41.14
7,198,160 B2 * 4/2007 Ernst et al. ..... 211/150
7,264,126 B1 * 9/2007 Bergeron ..... 211/41.14
2003/0038101 A1 * 2/2003 Linder et al. ..... 211/150
2004/0245195 A1 * 12/2004 Pride ..... 211/41.14
2006/0043032 A1 * 3/2006 McHugh ..... 211/41.14

* cited by examiner

*Primary Examiner*—Sarah Purol
(74) *Attorney, Agent, or Firm*—Tarolli, Sundheim, Covell & Tummino LLP

(57) ABSTRACT

A shipping rack that includes a frame and a support. The support is coupled to the frame such that the support is rotatable with respect to the frame between a loading position and a transport position. The support includes first and second walls in planes that intersect at approximately a right angle for supporting the plurality of panels with edges being supported by the first and second walls respectively. Movement of the glass support from the loading position to the transport position urges the plurality of panels toward the intersection.

14 Claims, 3 Drawing Sheets

PANEL SHIPPING RACK

FIELD OF THE INVENTION

The invention relates to shipping containers and packaging for securely supporting panels such as insulating glass units and glass sheets.

BACKGROUND OF THE INVENTION

Insulating glass units employed in windows and doors commonly are manufactured by sandwiching a peripheral spacer between aligned, parallel sheets of glass. The finished units are packaged and shipped to another location in which the glass units are provided with appropriate frames to form finished windows and doors. The sheets of glass used to construct insulating glass units are transported from a location where larger sheets are cut to form appropriately sized smaller sheets.

Containers have been developed for transporting sheets of glass and insulating glass units. One such container comprises a floor, an end wall supported at right angles to the floor, and a series of parallel rods extending from an upper edge of the wall to a lower, forward edge of the floor, the rods being spaced from one another by a distance enabling glass sheets to be inserted between the rod pairs. Although containers of this type are appropriate for conveying vertically aligned glass sheets for very short distances, such as across the flat floor of a factory, they can be inadequate for supporting glass units against breakage during shipment when the containers are subjected to bumps and jolts, since the individual glass units can move upwardly and forwardly parallel to their planes as well as from side-to-side. The container itself, as described, can be wrapped horizontally with a heat-shrinkable plastic film in an effort to stabilize the sheets, but if sheets of different sizes and shapes are intermingled, only the larger sheets will be supported.

Another such container is described in U.S. Pat. No. 6,120,206. This shipping container comprises a floor and an upright rear wall that intersect at approximately a right angle for vertically supporting a plurality of parallel panels, with the edges of the panels being supported by the floor and the rear wall. A plurality of elongated, elastic restraints, such as elastic cords, are carried by the container and are positioned so as to encounter a respective panel and to elastically urge that panel toward the intersection. Each elongated elastic restraint extends generally in the plane of its respective panel from the rear wall above the floor to the floor forwardly of the rear wall. The restraint contacts and elastically presses against the upper, forward corner of the glass unit. One drawback of this type of container is that it is tedious and time consuming to separately secure each panel with an individual elongated elastic restraint.

SUMMARY

The present invention concerns a shipping rack that includes a frame and a support. The support is coupled to the frame such that the support is rotatable with respect to the frame between a loading position and a transport position. The support includes first and second walls in planes that intersect at approximately a right angle for supporting the plurality of panels with edges being supported by the first and second walls respectively. Movement of the glass support from the loading position to the transport position urges the plurality of panels toward the intersection.

In one embodiment, latches are included that that secure the support in the loading position and the transport position. The second wall, when in the loading position, includes a plurality of spaced, generally vertically extending grooves shaped that are sized to receive and support rearward edges of the panels. The first wall may include a plurality of spaced floor grooves aligned with the generally vertically extending grooves. The floor grooves are shaped and sized to receive and support the bottom edges of parallel panels.

The present invention also concerns a method of loading and stabilizing a plurality of panels in a shipping rack. In the method, the support is placed in a loading position. Vertically oriented panels are slid into the support. The support and panels are rotated with respect to a frame from the loading position to a transport position where the panels are stabilized by the force of gravity.

BRIEF DESCRIPTION OF THE DRAWINGS AND PHOTOGRAPHS

DETAILED DESCRIPTION

Figure 2:
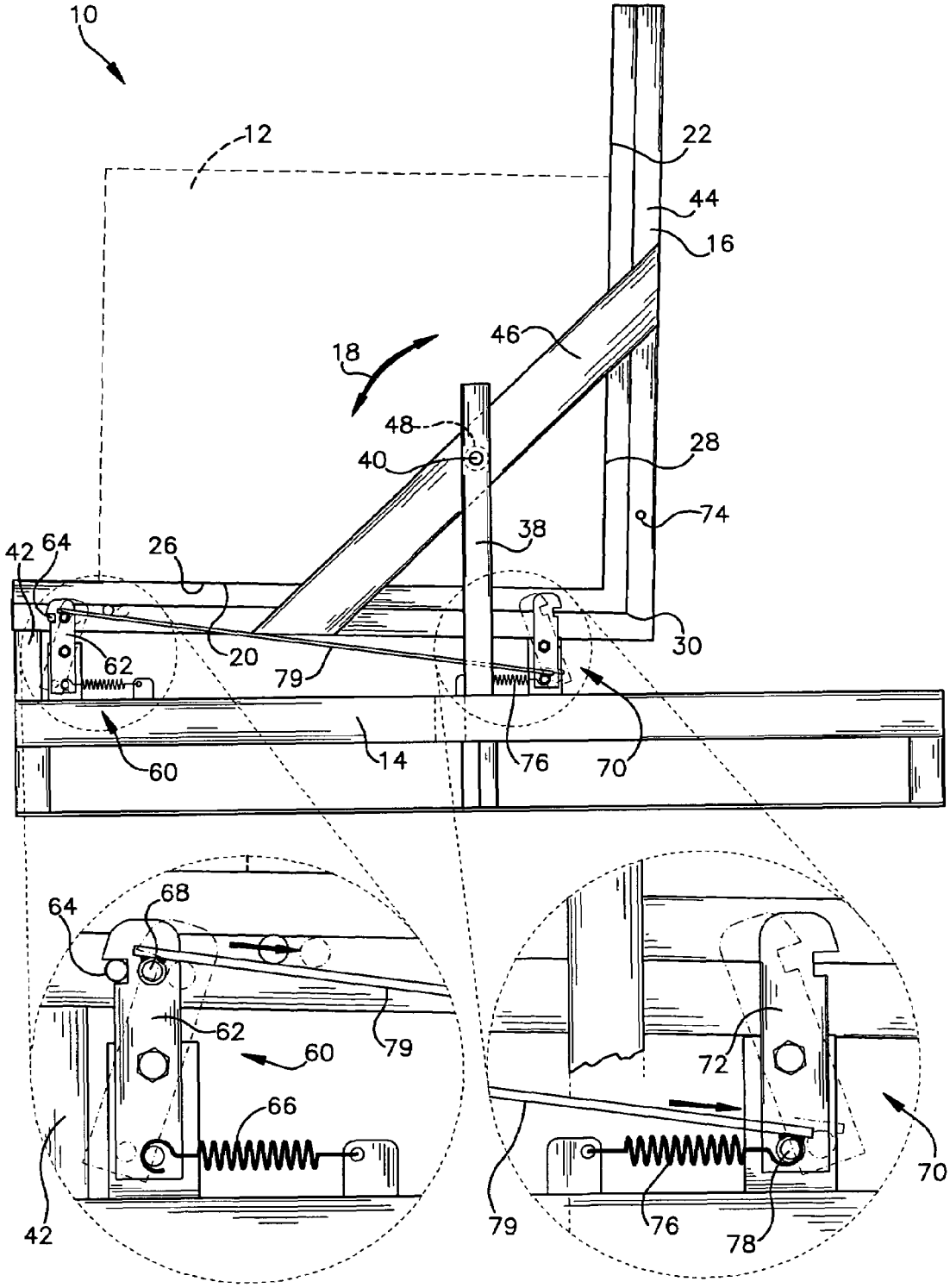
FIG. 2 is a side elevational view of a shipping rack with a support in a loading position.
Figure 3:
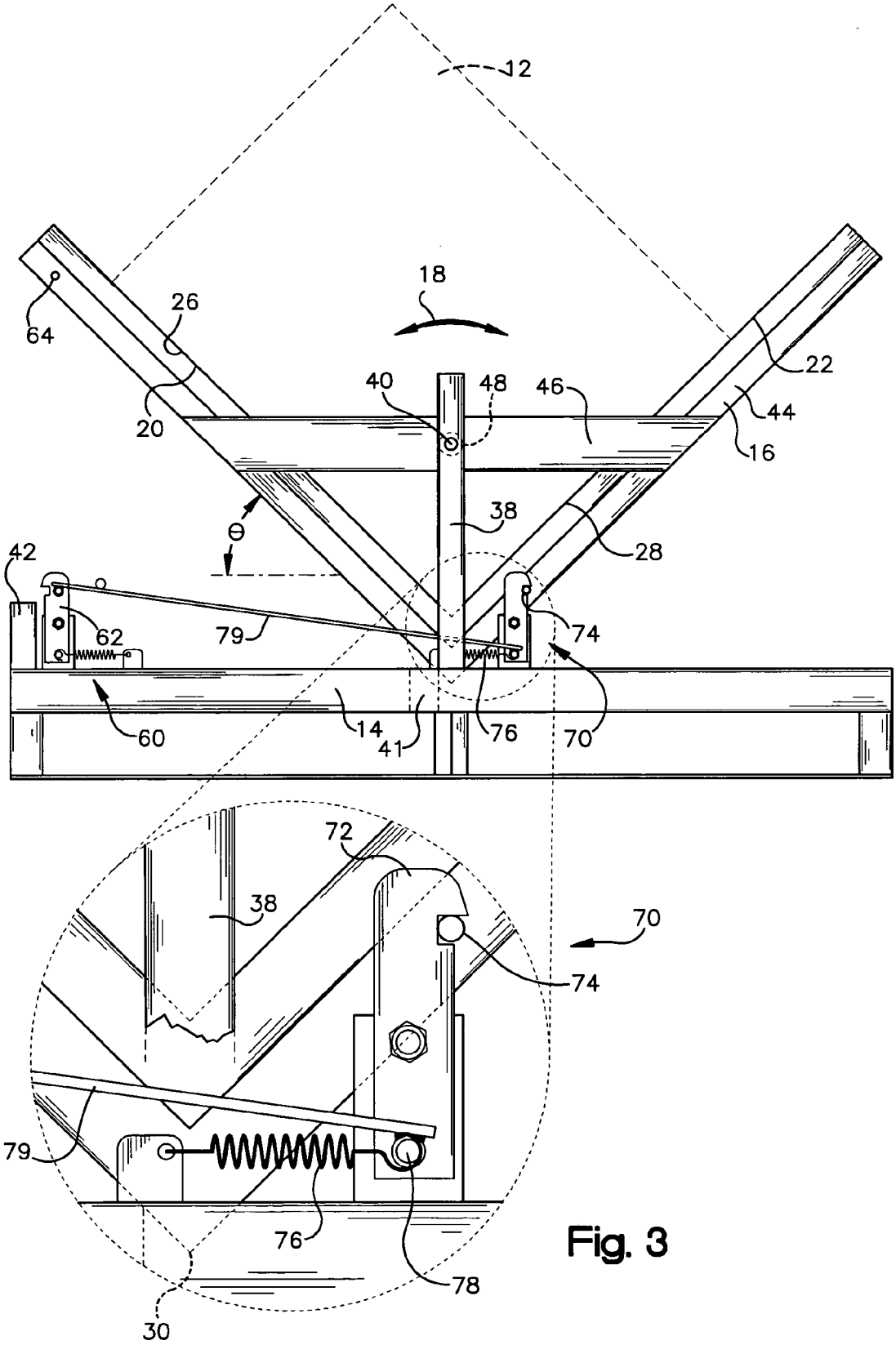
FIG. 3 is a side elevational view of a shipping rack with a support in a transport position.

The present application is directed to a shipping rack 10 for carrying a plurality of panels 12, such as glass sheets and/or insulating glass units. The rack 10 includes a frame 14 and a support 16. The support 16 is coupled to the frame 14 such that the support is rotatable with respect to the frame between a loading position (FIG. 2) and a transport position (FIG. 3). The support includes first and second walls 20, 22 in planes that intersect at approximately a right angle for supporting the plurality of panels 12. Bottom edges 26 of the panels are supported by the first wall 20. Rear edges 28 of the panels are supported by the second wall 22 (FIG. 2). Movement of the glass support 16 from the loading position (FIG. 2) to the transport position (FIG. 3) urges the plurality of panels toward an intersection 30 of planes defined by the first and second walls 20, 22.

The frame 14 is constructed from tubular members 32. Four tubular members 32 are welded to form a rectangular box. The box 34 is supported by a plurality of legs 36. Bottom surfaces of the legs 36 define a plane that the frame 14 rests on. A pair of support posts 38 extend vertically from the box 34. A shaft 40 extends inwardly from each support post 38. A pair of stop posts 42 extend vertically from the box 34. The stop posts 42 limit downward movement of the first wall and thereby defines the loading position. A cross member 41 extends between two parallel tubular members 32 to provide additional structural support for the frame 14 and to act as a stop for the support 16 in the transport position (FIG. 3).

In the depicted embodiment, the first and second walls 20, 22 are supported by a frame 44. A pair of cross-members 46 extend from the first wall 20 to the second wall 22. A sleeve 48 extends outwardly from each of the cross-members 46. The sleeves 48 are disposed around the shafts 40, such that the sleeves are rotatable with respect to the shafts. This rotatable connection allows the support 16 to rotate with respect to the frame 14 between the loading and transport positions.

In the exemplary embodiment, an angle θ between a plane defined by a bottom surface of the frame (i.e. the ground) and the first wall 20 is between thirty degrees and sixty degrees when the support is in the transport position. In the illustrated embodiment this angle is approximately forty-five degrees.

The second wall 22 includes a plurality of spaced grooves 50 that are sized and shaped to receive and support rearward edges 28 of the panels 12. In the loading position, the spaced grooves are generally vertically extending. The first wall includes a plurality of spaced floor grooves 54 aligned with the grooves 50. The floor grooves 54 are shaped and sized to receive and support the bottom edges 26 of the panels 12. In the loading position, the spaced grooves are generally horizontally extending.

In the exemplary embodiment shown best in FIG. 2, a latch 60 that secures the support in the loading position is included. The illustrated latch 60 includes a hasp 62, a post 64, and a biasing member 66 such as a spring. The hasp 62 is rotatably connected to the frame 14, such that the hasp is moveable from a latching position to a disengaged position shown in phantom. The biasing member 66 is connected to the hasp 62 and the frame 14, such that the biasing member 66 biases the hasp to the latching position. The post 64 extends from the frame 14. The hasp 62 is latched around the post 64 when the support is in the loading position. A handle 68 extends from the hasp for moving the hasp from the latching position to the disengaged position. Once in the disengaged position, the support 16 can be moved from the loading position to the transport position. When the support 16 is moved from the transport position to the loading position, the post 64 engages and moves the hasp toward the disengaged position. When the support reaches the loading position, the biasing force of the spring latches the hasp 62 over the post 64 to secure the support in the loading position. It should be readily apparent that a wide variety of different latches could be used to secure the support in the loading position.

As best shown in FIGS. 2 and 3, a latch 70 that secures the support in the transport position is included. The illustrated latch 70 includes a hasp 72, a post 74, and a biasing member 76 such as a spring. The hasp 72 is rotatably connected to the frame 14, such that the hasp is moveable from a latching position to a disengaged position. The biasing member 76 is connected to the hasp 72 and the frame 14, such that the biasing member 76 biases the hasp to the latching position. The post 74 extends from the frame 14. The hasp 72 is latched around the post 74 when the support is in the transport position. An optional handle 78 extends from the hasp for moving the hasp from the latching position to the disengaged position. In the embodiment depicted in FIGS. 1-3 a rod 79 couples the handle 68 to the latch 70 at the location of the handle 78. In this embodiment, the handle 68 moves the latch from the latching position to the disengaged position and the handle 78 is not required. When in the transport position, movement of the bottom wall 20 is constrained by contact with the cross member 41. Once the latch 70 is in the disengaged position, the support 16 can be moved from the transport position to the loading position. When the support 16 is moved from the loading position to the transport position, the post 74 engages and moves the hasp toward the disengaged position. When the support reaches the transport position, the biasing force of the spring latches the hasp 72 over the post 74 to secure the support in the transport position. It should be readily apparent that a wide variety of different latches could be used to secure the support in the transport position.

Figure 1:
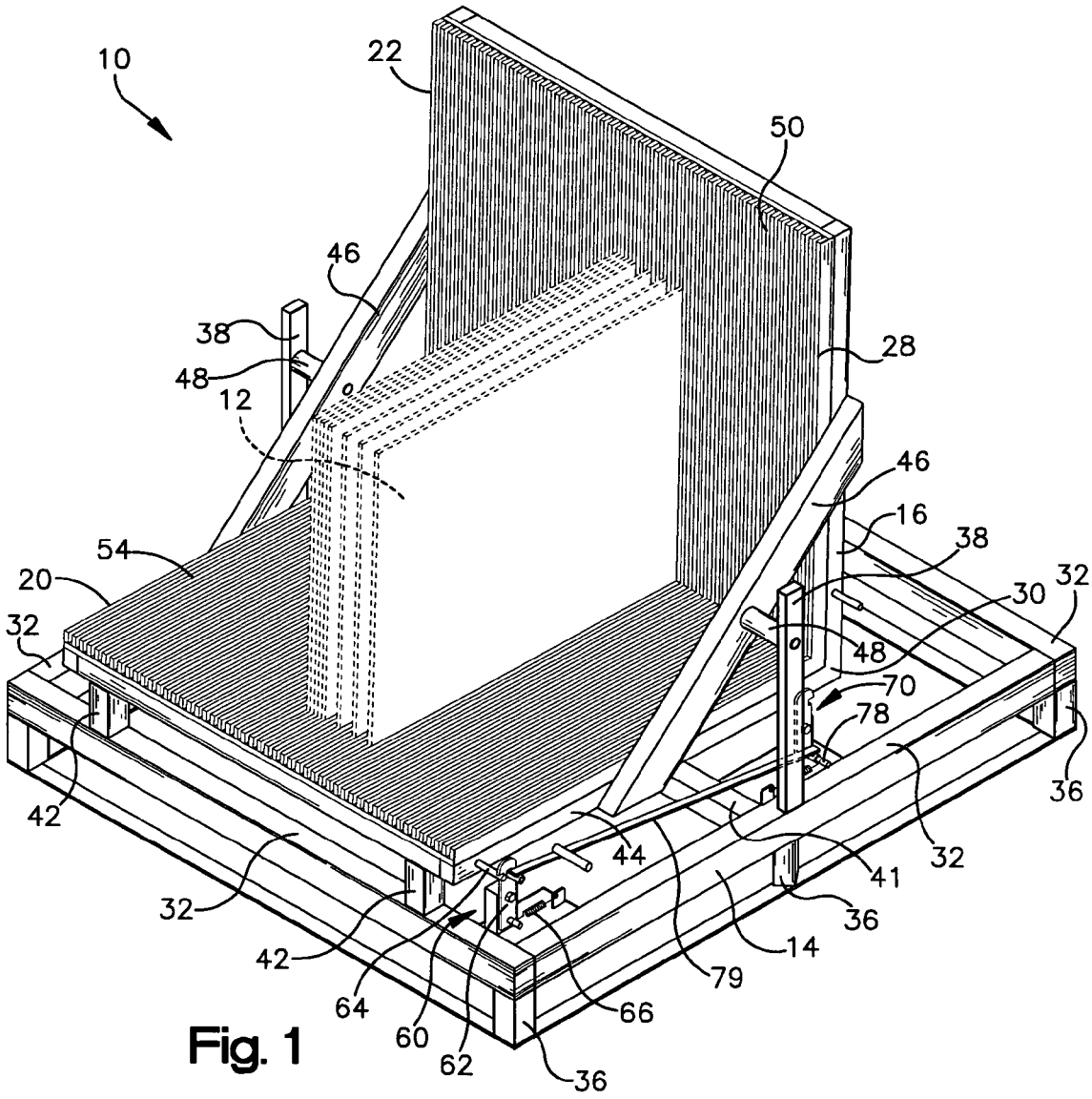
FIG. 1 is a perspective view of a shipping rack constructed in accordance with one embodiment of the present invention.

The rack 10 is used to stabilizing a plurality of panels for shipping. The support 16 is positioned in the loading position (FIGS. 1 and 2). Vertically oriented panels 12 are slid into the support. The support 16 is then rotated with respect to the frame 14 from the loading position to the transport position (FIG. 3) where the panels are stabilized by the force of gravity.

While a single embodiment of the invention has been illustrated and described in detail, the present invention is not to be considered limited to the precise construction disclosed. Various modifications, adaptations and uses of the invention may occur to those skilled in the art to which the invention relates. The intention is to cover all such modifications, adaptations and uses falling within the spirit or scope of the claims.

The invention claimed is:

1. A shipping rack and a plurality of panels supported by the rack, the rack comprising:

a) a frame including a post extending upwardly from the frame;

b) a panel support coupled to the frame such that the panel support is rotatable with respect to the frame between a loading position and a transport position, wherein the panel support includes first and second walls in planes that intersect at approximately a right angle for supporting the plurality of panels with edges being supported by the first and second walls respectively, a cross member extending at an angle between the first and second walls, the cross member including a pivot structure coupled to the post, wherein movement of the panel support from the loading position to the transport position rotates the panel support about the pivot structure and urges the plurality of panels toward an intersection of the first and second walls.

2. The shipping rack of claim 1 wherein an angle between a plane defined by a bottom surface of the frame and a plane defined by the first wall is between thirty degrees and sixty degrees.

3. The shipping rack of claim 1 wherein an angle between a plane defined by a bottom surface of the frame and a plane defined by the first wall is approximately forty-five degrees.

4. The shipping rack of claim 1 further comprising a latch that secures the panel support in the loading position.

5. The shipping rack of claim 1 further comprising a latch that secures the panel support in the transport position.

6. The shipping container of claim 1 wherein said second wall in the loading position includes a plurality of spaced, generally vertically extending grooves shaped and sized to receive and support rearward edges of the panels.

7. The shipping container of claim 6 wherein said first wall includes a plurality of spaced floor grooves aligned with said generally vertically extending grooves, the floor grooves are shaped and sized to receive and support the bottom edges of parallel panels.

8. A method of loading and stabilizing a plurality of panels in a shipping rack, comprising:

a) providing a shipping rack comprising a frame including a post extending upwardly from the frame; a panel support coupled to the frame such that the panel support is rotatable with respect to the frame between a loading position and a transport position, wherein the panel support includes first and second walls in planes that intersect at an angle for support the plurality of panels with edges being supported by the first and second walls respectively, a cross member extending at an angle between the first and second walls, the cross member including a pivot structure coupled to the post;

b) positioning the panel support in the loading position;

c) sliding vertically oriented panels into the support;

d) rotating the panel support and panels about the pivot structure with respect to the frame from the loading position to a transport position where the panels are stabilized by the force of gravity.

9. The method of claim 8 wherein the support includes first and second walls in planes that intersect at approximately a right angle for supporting the panels with edges being supported by the first and second walls respectively, wherein movement of the panel support from the loading position to the transport position urges the plurality of panels toward an intersection of the first and second walls to stabilize the panels.

10. The method of claim 9 wherein an angle between a plane defined by a bottom surface of the frame and a plane defined by the first wall is between thirty degrees and sixty degrees.

11. The method of claim 9 wherein an angle between a plane defined by a bottom surface of the frame and a plane defined by the first wall is approximately forty-five degrees.

12. The shipping rack of claim 1 wherein the post comprises a pair of posts, a first post extending upwardly from the frame on a first side of the panel support and a second post extending upwardly from the frame on an opposite side of the panel support, and further wherein the cross member includes a pair of cross members, a first cross member extending between the first and second walls on the first side of the panel support and a second cross member extending between the first and second walls on the opposite side of the panel support, the first cross member including a pivot structure coupled to the first post and the second cross member including a pivot structure coupled to the second post.

13. The method of claim 8 wherein the post comprises a pair of support posts, a first post extending upwardly from the frame on a first side of the panel support and a second post extending upwardly from the frame on an opposite side of the panel support, and further wherein the cross member includes a pair of cross members, a first cross member extending between the first and second walls on the first side of the panel support and a second cross member extending between the first and second walls on the opposite side of the panel support, the first cross member including a pivot structure coupled to the first post and the second cross member including a pivot structure coupled to the second post.

14. A shipping rack for supporting a plurality of panels, the rack comprising:

a) a frame including a post extending upwardly from the frame;

b) a panel support coupled to the frame such that the support is rotatable with respect to the frame between a loading position and a transport position, wherein the panel support includes first and second walls that intersect at approximately a right angle, a cross member extending between the first and second walls, the cross member including a pivot structure coupled to the post, the pivot structure rotatable about an axis substantially parallel to the first and second walls, movement of the panel support from the loading position to the transport position rotating the panel support about the pivot structure and, in the loading position, an angle between a plane defined by a bottom surface of the frame and the first plane defined by the first wall is between thirty degrees and sixty degrees.

* * * * *